US006025120A

United States Patent [19]

Suzuki et al.

[11] Patent Number: 6,025,120

[45] Date of Patent: Feb. 15, 2000

[54] SILVER HALIDE COLOR PHOTOGRAPHIC LIGHT SENSITIVE MATERIAL

[75] Inventors: Takatugu Suzuki; Shuichi Sugita, both of Hino, Japan

[73] Assignee: Konica Corporation, Japan

[21] Appl. No.: 09/113,687

[22] Filed: Jul. 10, 1998

[30] Foreign Application Priority Data

Jul. 16, 1997 [JP] Japan ..... 9-191285
May 14, 1998 [JP] Japan ..... 10-131998

[51] Int. Cl.[7] ..... G03C 1/08; G03C 7/26; G03C 7/32

[52] U.S. Cl. ..... 430/558; 430/543

[58] Field of Search ..... 430/543, 558

[56] References Cited

U.S. PATENT DOCUMENTS

| | | | |
|---|---|---|---|
| 4,774,172 | 9/1988 | Kawagishi et al. | 430/558 |
| 4,822,730 | 4/1989 | Furutachi et al. | 430/558 |
| 5,066,575 | 11/1991 | Sato et al. | 430/558 |
| 5,254,451 | 10/1993 | Kita et al. | 430/558 |
| 5,409,808 | 4/1995 | Mizukawa et al. | 430/558 |
| 5,565,313 | 10/1996 | Ishidai et al. | 430/558 |
| 5,576,150 | 11/1996 | Tang et al. | 430/558 |
| 5,605,788 | 2/1997 | Kawagishi et al. | 430/558 |
| 5,609,996 | 3/1997 | Tang et al. | 430/558 |
| 5,645,981 | 7/1997 | Romanet et al. | 430/558 |
| 5,667,952 | 9/1997 | Tang et al. | 430/558 |
| 5,698,386 | 12/1997 | Tang et al. | 430/558 |
| 5,858,635 | 1/1999 | Nakamine et al. | 430/558 |

FOREIGN PATENT DOCUMENTS 0660177 6/1995 European Pat. Off. .

OTHER PUBLICATIONS

Patent Abstracts of Japan, Publication #08166659, Publication date: Jun. 25, 1996.

*Primary Examiner*—Geraldine Letscher
*Attorney, Agent, or Firm*—Jordan B. Bierman; Bierman, Muserlian and Lucas

[57] ABSTRACT

A silver halide color photographic light sensitive material is disclosed. The material comprises a green-sensitive silver halide emulsion layer containing a magenta coupler represented by the formula:

10 Claims, No Drawings

SILVER HALIDE COLOR PHOTOGRAPHIC LIGHT SENSITIVE MATERIAL

FIELD OF THE INVENTION

The present invention relates to a silver halide color photographic light sensitive material containing a magenta coupler and in particular to a silver halide color photographic light sensitive material containing a novel pyrazolotriazole magenta coupler which is superior in color forming property and color reproduction, forming color images stable to heat and light.

BACKGROUND OF THE INVENTION

As couplers generally employed in silver halide color photographic light sensitive materials, there are known a yellow coupler comprised of a open-chained ketomethylene compound, a magenta coupler comprised of a pyrazolone or pyrazolotriazole compound and a cyan coupler comprised of a phenol or naphthol compound.

Known pyrazolone magenta couplers are described in U.S. Pat. Nos. 2,600,788 and 3,519,429 and JP-A 49-111631 and 57-35858 However, as described in The Theory of the Photographic Process, Macmillan Co. 4th Edition (1977), page 356-358; Fine Chemical Vol.14, No. 8 page 38–41 (published by CMC) and Abstracts of Annual Conference in 1985 of the Society of Photographic Science and Technology of Japan page 108–110, a dye formed from the pyrazolone magenta coupler has an unwanted side absorption and its improvement is desired.

On the other hand, as described in the above references, a dye formed from the pyrazolotriazole magenta coupler has no side absorption. This coupler is superior one, as described in the above references, U.S. Pat. Nos. 3,725,067, 3,758,309 and 3,810,761.

However, light fastness of a azomethine dye formed from the pyrazolotriazole magenta coupler is markedly low, leading to deterioration in photographic performance of silver halide color photographic light sensitive material and particularly those used for prints.

Studies of improvements in the light fastness have been made so far. JP-A 59-125732, 61-282845, 61-292639 and 61-279855 disclose a technique in which a pyrazoloazole magenta coupler is employed in combination with a phenol compound or phenyl ether compound; JP-A 61-72246, 62-208048, 62-157031 and 63-163351 disclose a technique of using an amine compound in combination.

JP-A 63-24256 proposes a pyrazoloazole magenta coupler having an alkyloxyphenyloxy group.

However, improvements in light fastness of magenta dye images through these techniques were proved to be insufficient and further improvements are strongly desired.

SUMMARY OF THE INVENTION

The present invention has been developed so as to dissolve the problems mentioned above. It is an object of the present invention to provide a silver halide color photographic light sensitive material superior in color forming property and improved in light fastness of magenta dye images.

A silver halide color photographic light sensitive material of the invention comprises a blue-sensitive silver halide emulsion layer, green-sensitive silver halide emulsion layer and a red-sensitive silver halide emulsion layer, wherein said green-sensitive silver halide emulsion layer comprises a coupler represented by the following formula (M-I):

Formula (M-I)

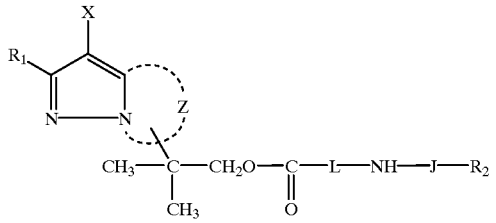

wherein $R_1$ represents a substituent; $R_2$ represent an alkyl group, cycloalky group or aryl group, all of which may have a substituent; L represents an alkylene group which may have a substituent; J represents a group of —(C═O)— or —(O═S═O)—; X represents a hydrogen atom or a group capable of being released upon reaction with an oxidation product of a developing agent; and Z represents an atomic group necessary for forming a nitrogen-containing heterocyclic group.

DETAILED DESCRIPTION OF THE INVENTION

In the formula (M-I), examples of the substituent represented by $R_1$ includes an alkyl group (e.g., methyl, ethyl, propyl, isopropyl, (t)-butyl, pentyl, cyclopentyl, hexyl, cyclohexyl, octyl, dodecyl), alkenyl group (e.g., vinyl, allyl), alkynyl group (e.g., propargyl), aryl group (e.g., phenyl, naphthyl), heterocyclic group (e.g., pyridyl, thiazolyl, oxazolyl, imidazolyl, furyl, pyrrolyl, pyrazinyl, pyrimidinyl, pyridazinyl, selenazolyl, sulfolanyl, piperidinyl, pyrazolyl, tetrazolyl), halogen atom (e.g., chlorine atom, bromine atom, iodine atom, fluorine atom), alkoxy group (e.g., methoxy, ethoxy, propyloxy, pentyloxy, cyclopentyloxy, hexyloxy, cyclohexyloxy, octyloxy, dodecyloxy), aryloxy group (e.g., phenoxy, naphthyloxy), alkoxycarbonyl group (e.g., methyloxycarbonyl, ethyloxycarbonyl, butyloxycarbonyl, octyloxycarbonyl, dodecyloxycarbonyl), aryloxycarbonyl group (e.g., phenyloxycarbonyl, naphthyloxycarbonyl), sulfonamido group (e.g., methylsulfonylamino, ethylsulfonylamino, butylsulfonylamino, hexylsulfonylamino, cyclohexylsulfonylamino, octylsulfonylamino, dodecylsulfonylamino, phenylsulfonylamino), sulfamoyl group (e.g., aminosulfonyl, methylaminosulfonyl, dimethylaminosulfonyl, butylaminosulfonyl, hexylaminosulfonyl, cyclohexylaminosulfonyl, octylaminosulfonyl, dodecyaminosulfonyl, phenylaminosulfonyl, naphthylaminosulfonyl, 2-pyridylaminosulfonyl), ureido group (e.g., methylureido, ethylureido, pentylureido, cyclohexylureido, octylureido, dodecylureido, phenylureido, naphthylureido, 2-pyridylaminoureido), acyl group (e.g., acetyl, ethylcarbonyl, propylcarbonyl, pentylcarbonyl, cyclohexylcarbonyl, octylcarbonyl, 2-ethylhexylcarbonyl, dodecylcarbonyl, phenylcarbonyl, naphthylcarbonyl, pyridylcarbonyl), acyloxy group (e.g.,acetyloxy, ethylcarbonyloxy, butylcarbonyloxy, octylcarbonyloxy, dodecylcarbonyloxy, phenylcarbonyloxy), carbamoyl group (e.g., aminocarbonyl, methylaminocarbonyl, dimethylaminocarbonyl, propylaminocarbonyl, pentylaminocarbonyl, cyclohexylaminocarbonyl, octylamino-carbonyl, 2-ethylhexylaminocarbonyl, dodecylaminocarbonyl, phenylaminocarbonyl, naphthylaminocarbonyl, 2-pyridylaminocarbonyl), amido group (e.g., methylcarbonylamino, ethylcarbonylamino, dimethylcarbonylamino, propylcarbonylamino, pentylcarbonylamino, cyclohexylcarbonylamino, 2-ethylhexylcarbonylamino, octylcarbonylamino, dodecylcarbonylamino, phenylcarbonylamino, naphthylcarbonylamino), sulfonyl group (e.g., methylsulfonyl, ethylsulfonyl, butylsulfonyl, cyclohexylsulfonyl, 2-ethylhexylsulfonyl, dodecylsulfonyl, phenylsulfonyl, naphthylsulfonyl, 2-pyridylsulfonyl), amino group (e.g., amino, ethylamino, dimethylamino, butylamino, cyclopentylamino, 2-ethylkhexylamino, dodecylamino, anilino, naphtylamino, 2-pyridylamino), cyano group, nitro group, sulfo group, carboxyl group, and hydroxyl group. These groups may be substituted by the substituent described above. Of these groups are preferred the alkyl group, cycloalkyl group, alkenyl group, aryl group, acylamino group, sulfonamido group, alkylthio group, arylthio group, halogen atom, heterocyclic group, sulfonyl group, sulfinyl group, phosphonyl group, acyl group, carbamoyl group, sulfamoyl group, cyano group, alkoxy group, aryloxy group, acyloxy group, amino group, alkylamino group, ureido group, alkoxycarbonyl, aryloxycarbonyl and carboxyl; an alkyl group is more preferred and t-butyl group is furthermore preferred.

In the formula (M-I), $R_2$ represents an alkyl group, cycloalkyl group or aryl group, all of which may have a substituent.

The preferable example of the alkyl group represented by $R_2$ are those having carbon atoms of 1 to 32, and the typical examples include methyl, ethyl, propyl, iso-propyl, t-butyl, hexyl, octyl, dodecyl, hexadecyl and 2-ethylhexyl.

In case that the alkyl group represented by $R_2$ has a substituent, the substituent is cited the same one as described in $R_1$ in the formula (M-I).

The preferable example of the cycloalkyl group represented by $R_2$ are those having carbon atoms of 3 to 12, and the typical examples include cyclopropyl, cyclopentyl, cyclohexyl, 2-methylcyclohexyl and adamantyl.

In case that the cycloalkyl group represented by $R_2$ has a substituent, the substituent is cited the same one as described in $R_1$ in the formula (M-I).

The preferable example of the aryl group represented by $R_2$ are those having carbon atoms of 6 to 14, and the typical examples include phenyl, 1-naphtyl and 2-naphtyl.

In case that the aryl group represented by $R_2$ has a substituent, the substituent is cited the same one as described in $R_1$ in the formula (M-I).

In the formula (M-I) L represents an alkylene group which may have a substituent.

The alkylene group represented by L is, for example, methylene, ethylene, trimethylene and tetramethylene.

In case that the alkylene group represented by L has a substituent, the substituent is cited the same one as described in $R_1$ in the formula (M-I).

Examples of an alkylene group represented by L are shown as below.

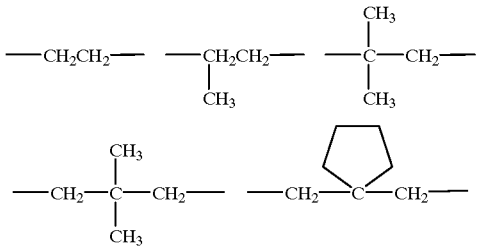

-continued

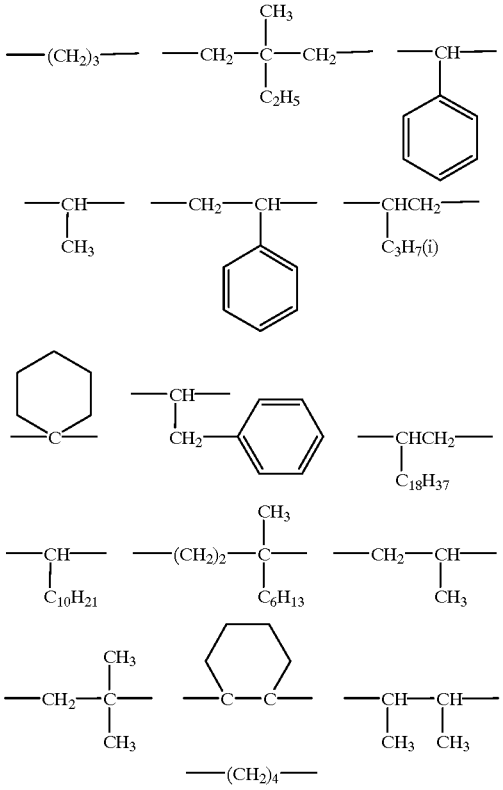

In the formula (M-I) L is preferably an ethylene group which may have a substituent, and more preferably a non-substituted ethylene group.

In the formula (M-I) J represents a group of —(C=O)— or —(O=S=O)—.

In the formula (M-I), X represents a hydrogen atom, a halogen atom (e.g., chlorine atom, bromine atom and fluorine atom), or a coupling-off group, which is capable of being released upon reaction with an oxidation product of a developing agent. Examples the coupling-off group include alkoxy, aryloxy, heterocyclic-oxy, acyloxy, sulfonyloxy, alkoxycarbonyloxy, aryloxycarbonyloxy, alkyloxalyloxy, alkoxyoxalyloxy, alkylthio, arylthio, heterocyclic-thio, alkyloxythiocarbonylthio, acylamino, sulfonamido, N atom-bonded nitrogen containing heterocyclic ring, alkyloxycarbonylamino, aryloxycarbonylamino and carboxyl. Of these are preferred halogen atoms, more preferably, a chlorine atom.

In the formula (M-I), a nitrogen-containing heterocyclic ring represented by Z include a pyrazole ring, imidazole ring, triazole ring, tetrazole ring. Of these, preferred is a triazole ring. In the formula (M-I) preferable skeletons are represented by the following (I) and (II), more preferably, (I):

(I)

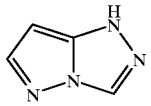

-continued
(II)
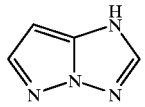
So the preferable magenta coupler can be rewritten by the following formulae;
M-Ia
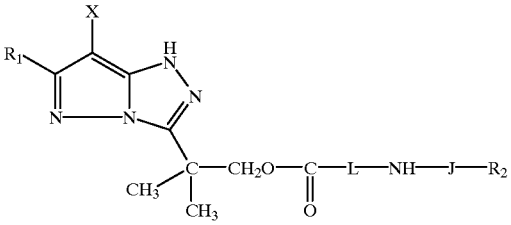
-continued
M-Ib
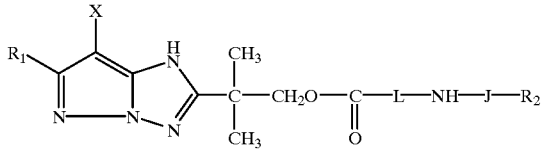
wherein $R_1$, $R_2$, X, L and J are the same as defined above.
Examples of the magenta coupler represented by formula (M-I) are shown below.
Examples of the compound
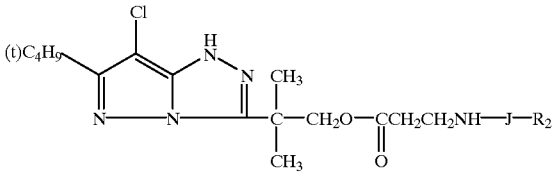
| Compound | —J— | —$R_2$ |
|---|---|---|
| M-1 | —CO— | —$C_{15}H_{31}$ |
| M-2 | —CO— | 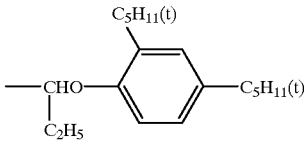 |
| M-3 | —CO— | 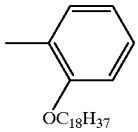 |
| M-4 | —CO— | 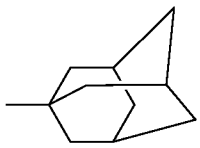 |
| M-5 | —CO— | —$(CH_2)_3SO_2C_{12}H_{25}$ |
| M-6 | —CO— | —$(CH_2)_3OC_{16}H_{33}$ |
| M-7 | —CO— | 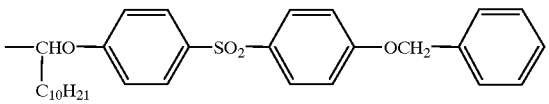 |

-continued
| | | |
|---|---|---|
| M-8 | —CO— | 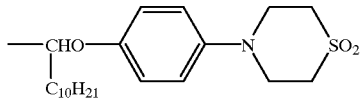 |
| M-9 | —CO— | 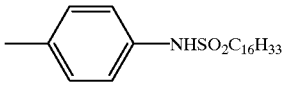 |
| M-10 | —CO— | 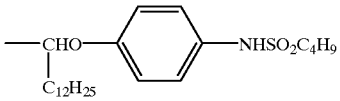 |
| M-11 | —CO— | 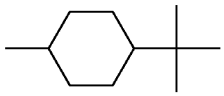 |
| M-12 | —CO— | 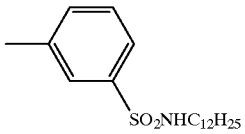 |
| M-13 | —CO— | 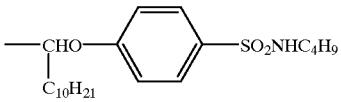 |
| M-14 | —CO— | 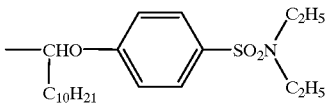 |
| M-15 | —$SO_2$— | 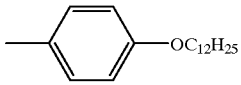 |
| M-16 | —$SO_2$— | 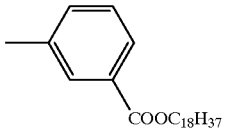 |
| M-17 | —$SO_2$— | 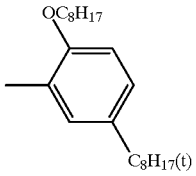 |
| M-18 | —CO— | 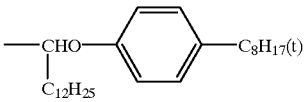 |

-continued
| | | |
|---|---|---|
| M-19 | —CO— | 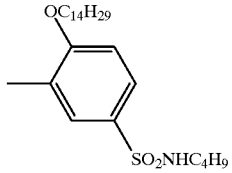 |
| M-20 | —CO— | 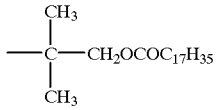 |
| M-21 | —CO— | 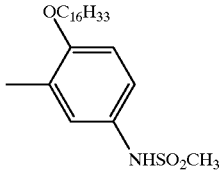 |
| M-22 | —CO— | 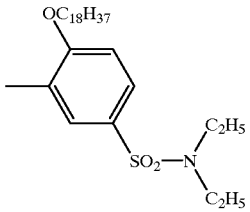 |
| M-23 | —CO— | 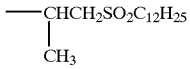 |
| M-24 | —CO— | 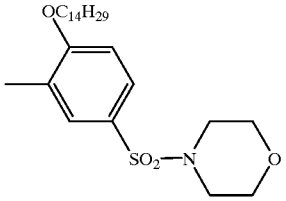 |
| M-25 | —CO— | 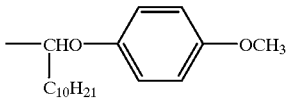 |
| M-26 | —CO— | 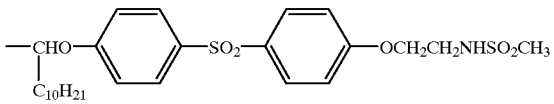 |
| M-27 | —$SO_2$— | $C_{16}H_{33}$ |

-continued
| | | |
|---|---|---|
| M-28 | $—SO_2—$ | 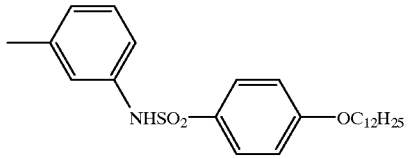 |
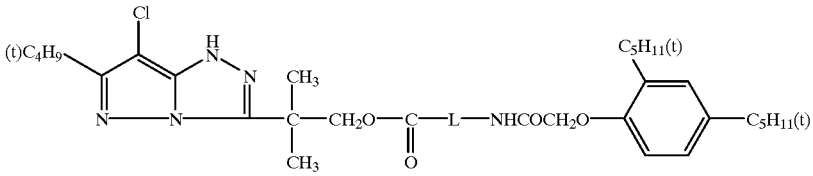
| Compound | L |
|---|---|
| M-29 | 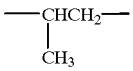 |
| M-30 | 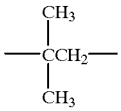 |
| M-31 | $—(CH_2)_3—$ |
| M-32 | 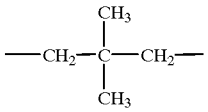 |
| M-33 | 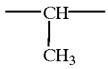 |
| M-34 | 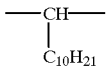 |
| M-35 | 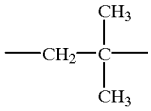 |
| M-36 | 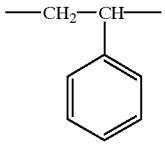 |
| M-37 | 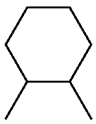 |

-continued
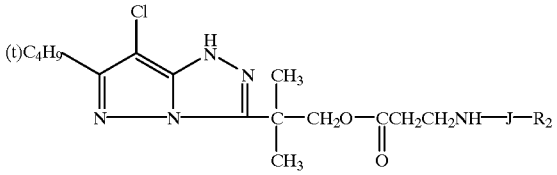
| Compound | —J— | —$R_2$ |
|---|---|---|
| M-38 | —CO— | 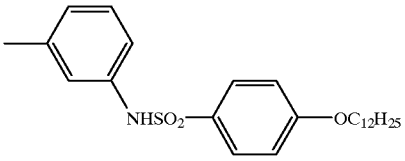 |
| M-39 | —$SO_2$— | —$(CH_2)_3OC_{12}H_{25}$ |
| M-40 | —CO— | 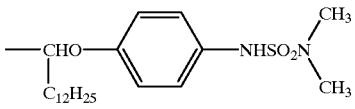 |
| M-41 | —CO— | 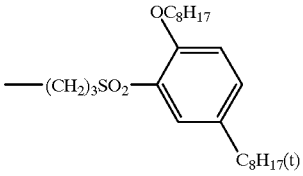 |
| M-42 | —CO— | 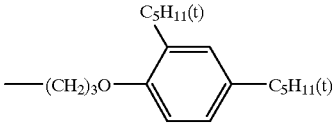 |
| M-43 | —CO— | 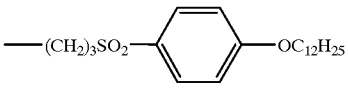 |
| M-44 | —CO— | —$(CH_2)_2SO_2C_{16}H_{33}$(i) |
| M-45 | —CO— | 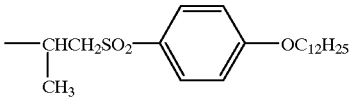 |
| M-46 | —CO— | —$CO(CH_2)_2COOC_{14}H_{29}$ |
| M-47 | —CO— | 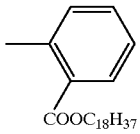 |
| M-48 | —CO— | 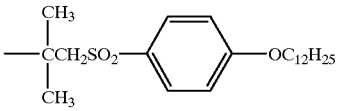 |

-continued
| | | |
|---|---|---|
| M-49 | —CO— | 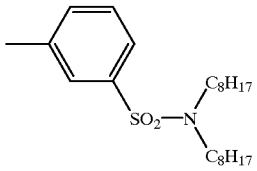 |
| M-50 | —$SO_2$— | 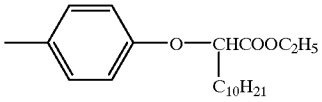 |
| M-51 | —CO— | 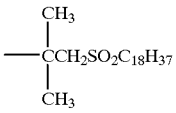 |
| M-52 | —CO— | 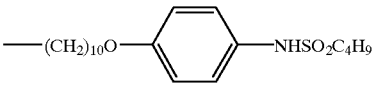 |
| M-53 | —$SO_2$— | 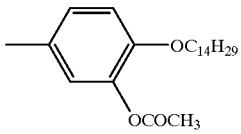 |
| M-54 | —$SO_2$— | 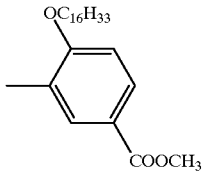 |
| M-55 | —CO— | 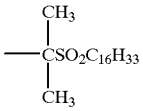 |
| M-56 | —$SO_2$— | 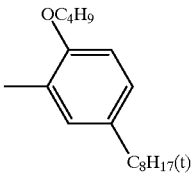 |

-continued
| | | |
|---|---|---|
| M-57 | —CO— | 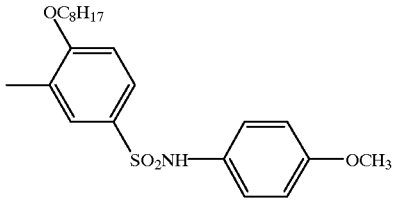 |
| M-58 | —CO— | 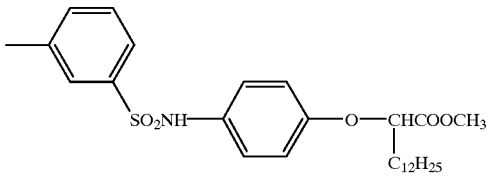 |
| M-59 | —CO— | 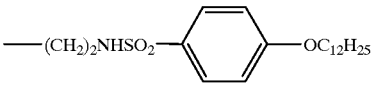 |
| M-60 | | 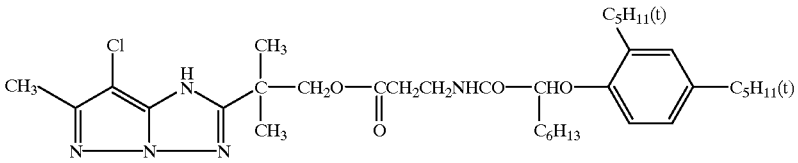 |
| M-61 | | 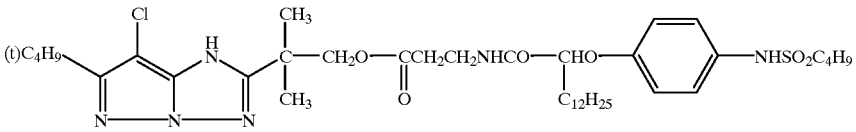 |
| M-62 | | 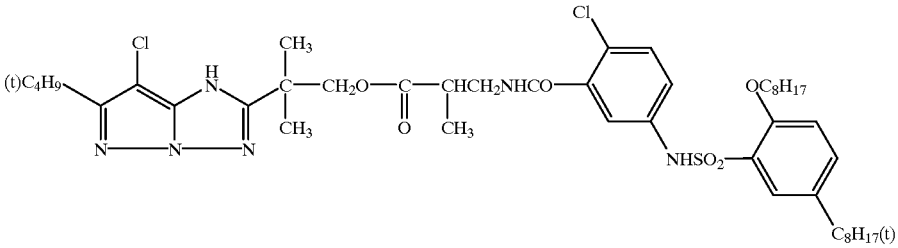 |
| M-63 | | 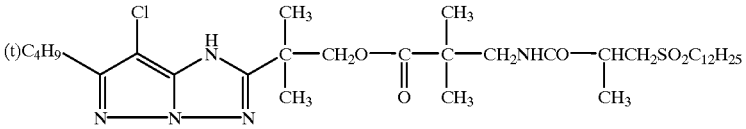 |
| M-64 | | 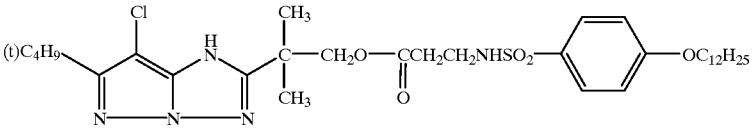 |

-continued
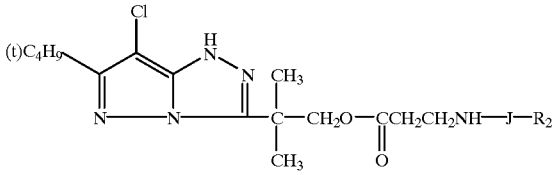
| Compound | —J— | —$R_2$ |
|---|---|---|
| M-65 | —CO— | 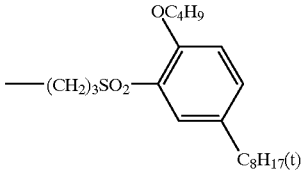 |
| M-66 | —CO— | 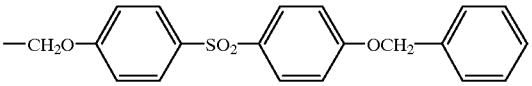 |
| M-67 | —CO— | 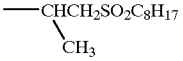 |
| M-68 | —CO— | 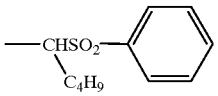 |
| M-69 | —CO— | 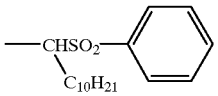 |
| M-70 | —CO— | 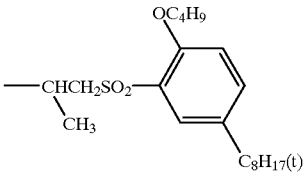 |
| M-71 | —CO— | 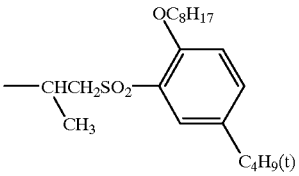 |
| M-72 | —CO— | 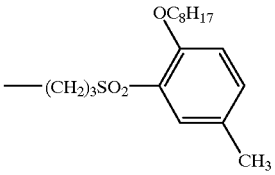 |
| M-73 | —CO— | 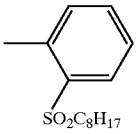 |

-continued
| | | |
|---|---|---|
| M-74 | —CO— | 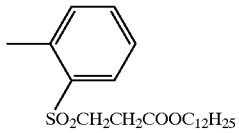 |
| M-75 | —CO— | 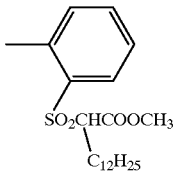 |
| M-76 | —CO— | 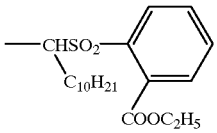 |
| M-77 | —CO— | 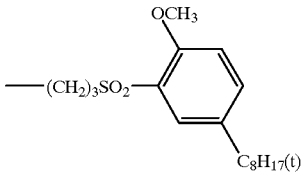 |
| M-78 | —CO— | 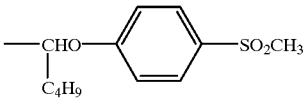 |
| M-79 | —CO— | 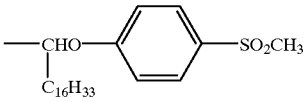 |
| M-80 | —CO— | 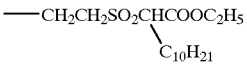 |
| M-81 | —CO— | 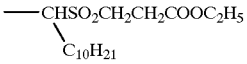 |
| M-82 | —CO— | 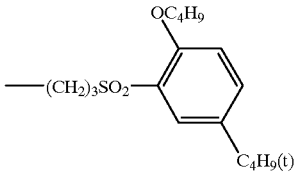 |
| M-83 | —CO— | 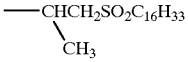 |
| M-84 | —CO— | 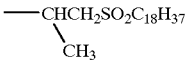 |
| M-85 | —CO— | 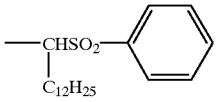 |

-continued

| | | |
|---|---|---|
| M-86 | —CO— | 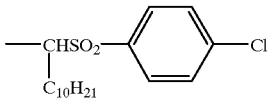 |

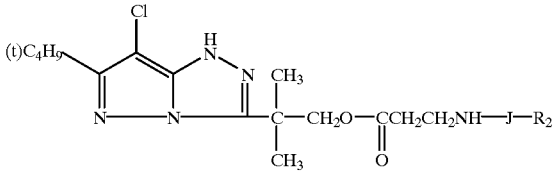

| Compound | —J— | —$R_2$— |
|---|---|---|
| M-87 | —CO— | 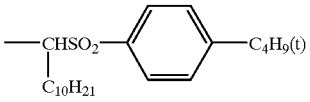 |
| M-88 | —CO— | —CH($SO_2C_8H_{17}$)—$C_6H_{13}$ |
| M-89 | —CO— | —CH($SO_2C_{12}H_{25}$)—$C_2H_5$ |
| M-90 | —CO— | —CH($SO_2C_{12}H_{25}$)—$C_4H_9$ |
| M-91 | —CO— | —CH($SO_2C_4H_9$)—$C_{10}H_{21}$ |
| M-92 | —CO— | —$CH_2CH_2COOC_{16}H_{33}$ |
| M-93 | —CO— | —$CH_2CH_2COOC_{18}H_{37}$ |
| M-94 | —CO— | 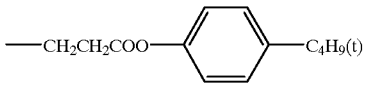 |
| M-95 | —CO— | 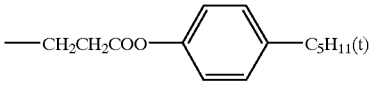 |
| M-96 | —CO— | 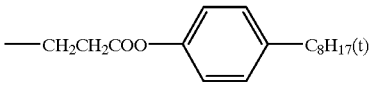 |
| M-97 | —CO— | —$C_{17}H_{35}$ |
| M-98 | —CO— | —$(CH_2)_7CH{=}CH(CH_2)_7CH_3$ |
| M-99 | —CO— | —$CH_2CH_2COO(CH_2)_8CH{=}CH(CH_2)_7CH_3$ |
| M-100 | —CO— | —$C_{13}H_{27}$ |

Magenta couplers represented by formula (M-I) according to the invention can be readily synthesized, with reference to Journal of Chemical Society, Perkin I (1977), 2047-2052; U.S. Pat. No. 3,725,067; JP-A 59-99437, 58-42045, 59-162548, 59-171956, 60-33552, 60-43659, 60-172982, 60-190779, 61-189539, 61-241754, 63-163351, 62-157031; Syntheses, 1981 page 40, ibid 1984, page 122, ibid 1984, page 894; JP-A 49-53574; British patent 1,410, 846; Shin Jikken Kagaku Kohza (New Series of Experimental Chemistry) Vol. 14-III, pages 1585–1594 (1977), published by Maruzen; Helv. Chem. Acta., 36, 75 (1953); J. Am. Chem. Soc., 72, 2726 (1950); and Org. Synth., Vol. II, page 395 (1943).

Typical synthesis example of the magenta coupler represented by formula (M-I) according to the invention is shown.

Synthesis Example

Synthesis of Compound M-3:

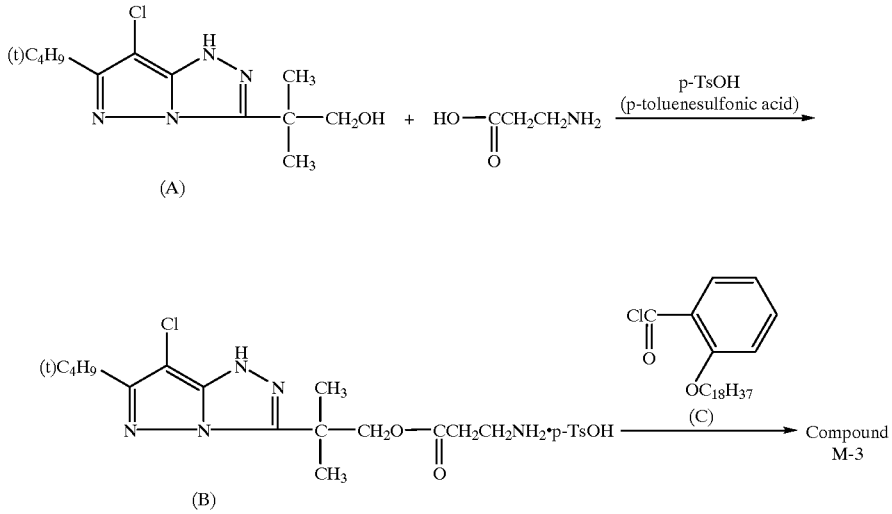

To compound (A) of 20.0 g β-alanine of 7.26 g and p-toluenesulfonic acid of 29.6 g and toluene of 300 ml were added, and the mixture was heated with reflux and removing water produced for 4 hours. After completing reaction, the reactant was made cool to room temperature, and deposited solid was filtrated. The obtained solid was washed by ethylacetate and water in sequence to obtain white compound (B) of 28.7 g.

To the obtained Compound (B) of 3.01 g, ethylacetate 20 ml and solution of potassium carbonate of 1.01 g dissolved in 10 ml water were added. The solution of Compound (C) of 2.39 g dissolved in 4 ml of ethylacetate was added dropwise slowly with vigorously stirring. The reaction was completed with stirring for 2 hours at room temperature after the completion of the addition. Thereafter water was removed and organic phase was washed with salted water three times. Ethyl acetate, a solvent, was removed under reduced pressure. The obtained residue was recrystallized from mixed solvent of ethylacetate and acetonitrile to obtain 3.88 g of white solid Compound (M-3). Melting point was 84.5–85.0° C.

The compound (M-3) was identified by mass spectrum and NMR spectrum.

Synthesis Example 2

Synthesis of Compound M-15

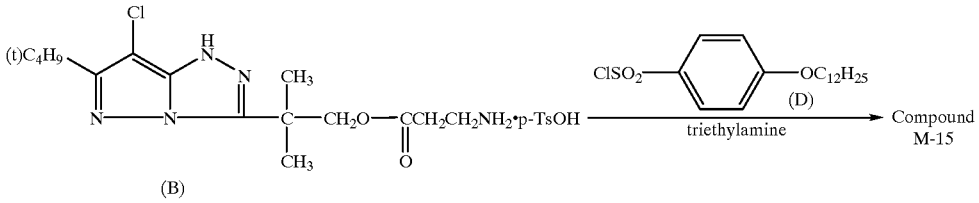

To compound (B) of 2.51 g, 30 ml of acetonitrile and 1.36 ml of triethylamine were added. To this, 1.76 g of Compound (D) was added slowly, and the mixture was stirred for five hours to complete the reaction. After the completion of reaction 50 ml of ethyl acetate and 50 ml of water were added to the reactant. After removing water, resulting organic phase was washed with dilute aqueous solution of sodium hydrogen carbonate and salted water in sequence. Ethyl acetate, a solvent, was removed under reduced pressure. The obtained residue was refined through column chromatography (silica gel, developer: ethyl acetate/n-hexane) to obtain 3.36 g of white solid Compound (M-15). Melting point was 86.0–88.0° C. The compound (M-15) was identified by mass spectrum and NMR spectrum.

Synthesis Example 3

Synthesis of Compound M-83

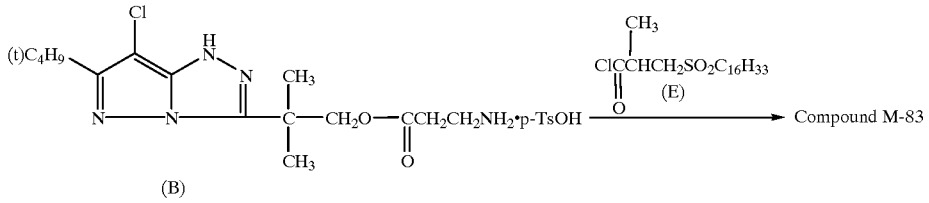

To the Compound (B) of 4.00 g, ethylacetate 30 ml and solution of potassium carbonate of 1.35 g dissolved in 10 ml water were added. The solution of Compound (E) of 3.08 g dissolved in 5 ml of ethylacetate was added dropwise slowly with vigorously stirring. The reaction was completed with stirring for 2 hours at room temperature after the completion of the addition. Thereafter water was removed and organic phase was washed with salted water three times. Ethyl acetate, a solvent, was removed under reduced pressure. The obtained residue was recrystallized from acetonitrile to obtain 3.73 g of white solid Compound (M-83). Melting point was 49° C.

The compound (M-83) was identified by mass spectrum and NMR spectrum.

Synthesis of Compound M-85

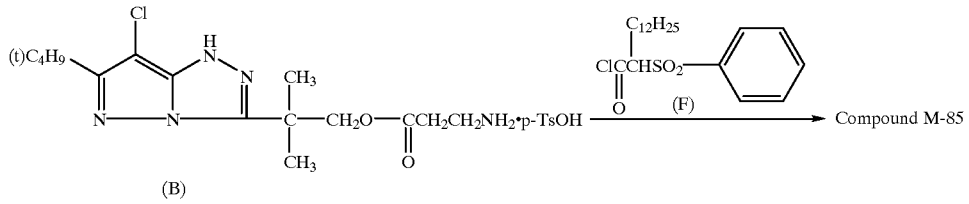

To the Compound (B) of 4.00 g, ethylacetate 30 ml and solution of potassium carbonate of 1.35 g dissolved in 10 ml water were added. The solution of Compound (F) of 3.19 g dissolved in 5 ml of ethylacetate was added dropwise slowly with vigorously stirring. The reaction was completed with stirring for 2 hours at room temperature after the completion of the addition. Thereafter water was removed and organic phase was washed with salted water three times. Ethyl acetate, ° C. Solvent was removed under reduced pressure. The obtained residue was recrystallized from acetonitrile to obtain 4.34 g of white solid compound M-85. Melting point was 88° C.

The compound (M-85) was identified by mass spectrum and NMR spectrum.

Synthesis Example 5

Synthesis of Compound 92

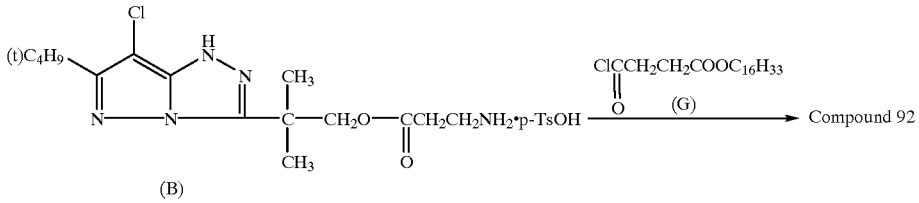

To the Compound (B) of 4.00 g, ethylacetate 30 ml and solution of potassium carbonate of 1.35 g dissolved in 10 ml water were added. The solution of Compound (G) of 2.98 g dissolved in 5 ml of ethylacetate was added dropwise slowly with vigorously stirring. The reaction was completed with stirring for 2 hours at room temperature after the completion of the addition. Thereafter water was removed and organic phase was washed with salted water three times. Ethyl acetate, a solvent, was removed under reduced pressure. The obtained residue was recrystallized from acetonitrile to obtain 3.65 g of white solid Compound (M-92). Melting point was 64° C.

The compound (M-92) was identified by mass spectrum and NMR spectrum.

According to the invention, the magenta coupler represented by formula (M-I) is preferably employed in combination with an image stabilizer represented by formulas (AO-I), (AO-II) and/or (AO-III). (AO-I)

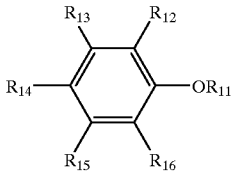

In the formula, $R_{11}$ represents a hydrogen atom, an alkyl group, aryl group, or heterocyclic group or a group represented by the following formula.

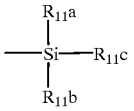

In the formula, $R_{11}a$, $R_{11}b$ and $R_{11}c$ each represent a mono-valent organic group. $R_{12}$, $R_{13}$, $R_{14}$, $R_{15}$, and $R_{16}$ each represent a hydrogen atom, a halogen atom or a group which may be substituted to benzene ring. Each of $R_{11}$ to $R_{16}$ may form a 5 or 6 member ring by bonding each other. (AO-II)

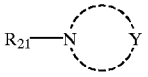

In the formula, $R_{21}$ represents an aliphatic group or an aromatic group; Y represents a n atomic group forming a 5–7 member ring together with nitrogen atom. (AO-III)

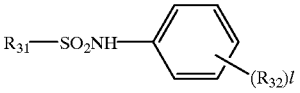

In the formula, $R_{31}$ represents an alkayl group; and $R_{32}$ represents a substituent; 1 is an integer of 0 to 5, wherein plural $R_{32}$ may be same or different in case of 1 is 2 or more.

In the formula (AO-I) alkyl group, aryl group, or heterocyclic group represented by $R_{11}$ is cited the same one as described in $R_1$ in the formula (M-I). The mono-valent organic group represented by $R_{11}a$, $R_{11}b$ and $R_{11}c$ includes an alkyl, aryl, alkoxy or aryloxy group or a halogen atom. Preferable example of $R_{11}$ is hydrogen atom or alkyl group. Substituent which may be substituted to benzene ring represented by $R_{12}$ to $R_{16}$ is cited the same substituent which is substituted further as described in $R_1$ in the formula (M-I). Preferable example of $R_{12}$, $R_{13}$, $R_{15}$, and $R_{16}$ is a hydrogen atom, hydroxy, alkyl, aryl, alkoxy, aryloxy, acylamino, and $R_{14}$ is preferably an alkyl, hydroxy, aryl, alkoxy or aryloxy group. $R_{11}$ and $R_{13}$, may form 5 or 6 member ring by closing mutually, and in this instance, $R_{14}$ is preferably a hydroxy, alkoxy or aryloxy group. $R_{11}$ and $R_{13}$, may form a methylenedioxy ring by closing. $R_{13}$ and $R_{14}$ may form 5 member hydrocarbon ring, and in this instance, $R_{11}$ is preferably an alkyl, aryl or hetero ring group.

Examples of the compound represented by formula (AO-I) are shown below.

Is-1

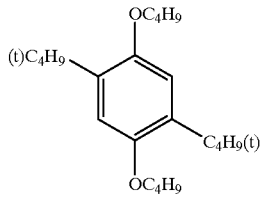

Is-2

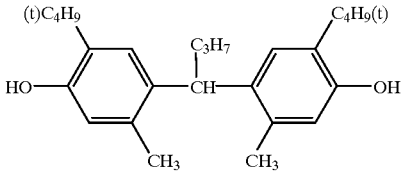

Is-3

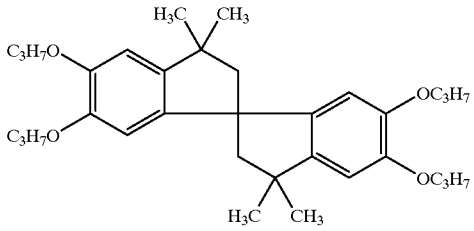

Is-4

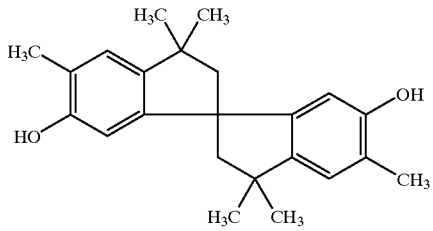

Is-5

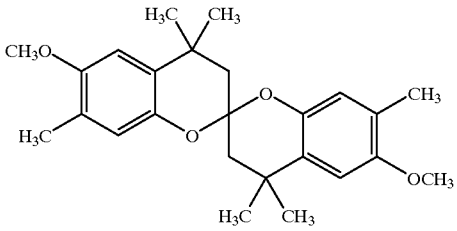

Is-6

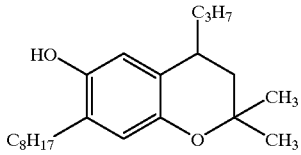

-continued

Is-7

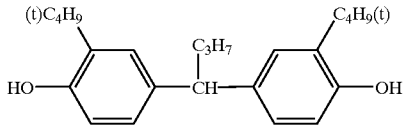

Is-8

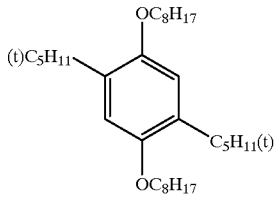

Is-9

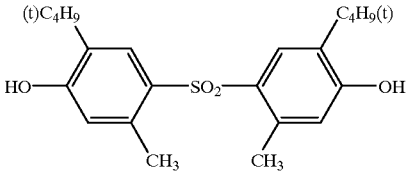

Is-10

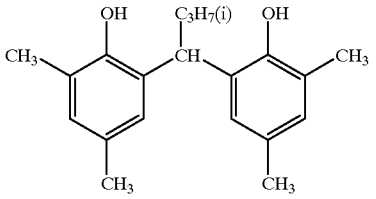

Further to the compounds exemplified above, examples of the compound represented by formula (AO-I) include those disclosed as A-1 to A-28 in JP-A 60-262159, pages 11-13; PH-1 to PH-29 in JP-A 61-14552, pages 8–10; B-1 to B-21 in JP-A-1-306846, page 6–7; I-1 to I-13, I'-1 to I'-8, II-1 to II-12, II'-1 to II'-21, III-8 to III-14, IV-1 to IV-24 and V-13 to V-17 in JP-A-2-958, pages 10–18; and II-1 to II-33 in JP-A-3-39956.

In the formula (AO-II) $R_{21}$ represents an aliphatic group or an aromatic group, whose preferable example includes an alkyl, aryl, and heterocycle group, more preferably, an aryl group. The heterocycle group formed by Y with nitrogen atom includes piperidine, piperazine, morpholine, thiomorohline, thiomorpholine-1,1,-dione, and pyrrolidine group.

Examples of the compound represented by formula (AO-II) are shown below.

IIs-1

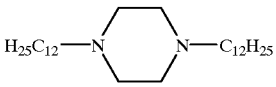

IIs-2

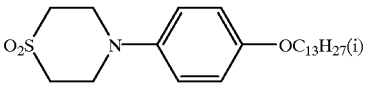

IIs-3

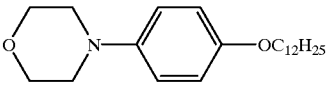

-continued

IIs-4

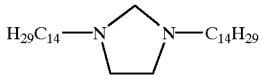

IIs-5

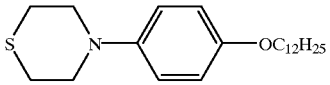

IIs-6

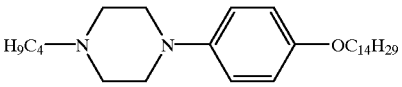

Further to the compounds exemplified above, examples of the compound represented by formula (AO-II) include those disclosed as B-1 to B-65 in JP-A 2-167543 and pages 8–11; (1) to (120) in JP-A 63-95439, pages 4–7.

In the formula (AO-III) alkyl group represented by $R_{31}$ is cited the same one as described in $R_1$ in the formula (M-I), and the substituent represented by $R_{32}$ is cited the same one as described in $R_1$ in the formula (M-I).

Alkyl group represented by $R_{31}$ is preferably non-substituted alkyl group having carbon atoms 1 to 16. Preferable example of $R_{32}$ includes an alkyl and alkoxy group and halogen atom. Examples of the compound represented by formula (AO-III) are shown below.

IIIs-1

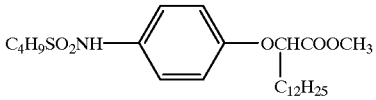

IIIs-2

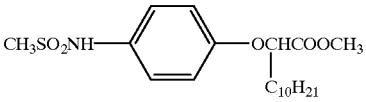

IIIs-3

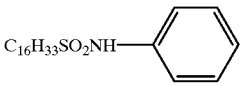

IIIs-4

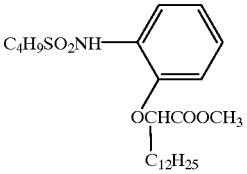

IIIs-5

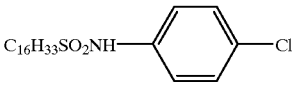

IIIs-6

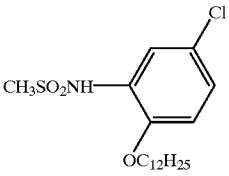

-continued

IIIs-7

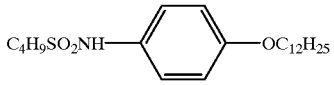

IIIs-8

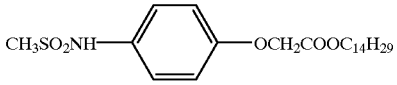

IIIs-9

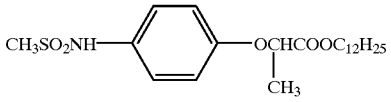

IIIs-10

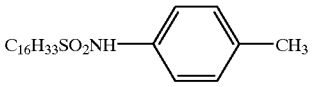

IIIs-11

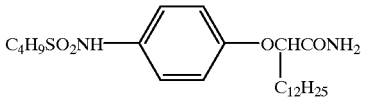

IIIs-12

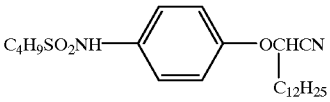

IIIs-13

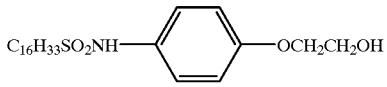

The image stabilizer represented by formula (AO-I), (AO-II) and (AO-III) is preferably used in an amount of 5 to 400 mol % and more preferably, 10 to 250 mol %, based on the magenta coupler represented by formula (M-I) according to the invention.

The magenta coupler and the image stabilizer are preferably contained together in the same layer, but the image stabilizer may be contained in a layer adjacent to a coupler containing layer.

The magenta coupler represented by formula (M-I) may be contained in an amount of $1\times10^{-3}$ to $8\times10^{-1}$, preferably, $1\times10^{-2}$ to $8\times10^{-1}$ per mol of silver halide.

The magenta coupler can be used in combination with another kind of coupler.

The magenta coupler is incorporated in such a manner that the coupler is, singly or in combination, dissolved in a mixture of a high boiling solvent such as dibutyl phthalate or tricresyl phosphate and a low boiling solvent such as butyl acetate or ethyl acetate or in the low boiling solvent alone, the resulting solution is mixed with an aqueous gelatin solution containing a surfactant and dispersed to be emulsified by using a high-speed rotating mixer, colloid mil or ultrasonic homogenizer, and the emulsion is directly incorporated into a silver halide emulsion. The emulsified dispersion can be set, and then shredded and washed with water, thereafter, added into a silver halide emulsion.

Magenta couplers each can be dispersed in a high boiling solvent and separately added into a silver halide emulsion, but the magenta couplers preferably are together dissolved and simultaneously dispersed.

The high boiling solvent is employed in an amount of 0.01 10 and preferably 0.1 to 3.0 g/g of magenta coupler As a silver halide emulsion usable in a photographic material according to the invention. any of conventionally used silver halide emulsions can be optionally used. The silver halide emulsion can be chemically sensitized in accordance with the conventional manner, and spectrally sensitized with a sensitizing dye to a desired wavelength region.

To the silver halide emulsion can be incorporated an adjutant such as antifoggant or stabilizer. Gelatin can advantageously be employed as a binder for the emulsion.

A silver halide emulsion layer and another hydrophilic colloid layer can be hardened. A plasticizer or a dispersion of a water insoluble or water sparingly soluble synthetic polymer (i.e., latex) can be incorporated. In a silver halide emulsion layer of a color photographic material, a coupler is employed.

Further, there can be incorporated a colored coupler having color correction effects, competing coupler and a compound capable of releasing, upon coupling reaction with an oxidation product of a developing agent, a photographically useful fragment, such as a development accelerator, bleach accelerator, developing agent, silver halide solvent, toning agent, hardener, fogging agent, antifogging agent, chemical sensitizer, spectral sensitizer or desensitizer.

Furthermore, an image stabilizer or UV absorbent can be incorporated to prevent deterioration of color images.

Paper laminated with polyethylene, polyethylene terephthalate film, baryta paper or cellulose triacetate film can be employed as a support.

To obtain color dye image, the photographic material, after exposure, can be subjected to color processing.

EXAMPLES

The present invention is explained based on example.

Example 1

On a paper support laminated with polyethylene on one side thereof and with polyethylene containing titanium oxide on the other side thereof, each of the layers having the compositions shown in Tables 1 and 2 was coated on the titanium oxide-containing polyethylene layer-side, so that Sample 101 of a multilayered silver halide photographic light-sensitive material was prepared.

TABLE 1

| Layer | Composition | Amount ($g/m^2$) |
|---|---|---|
| Layer 7 (Protective layer) | Gelatin | 1.00 |
| Layer 6 (UV-absorption layer) | Gelatin | 0.40 |
| | UV-absorbent (UV-1) | 0.10 |
| | Uv-absorbent (UV-2) | 0.04 |
| | UV-absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| Layer 5 (Red-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |

TABLE 1-continued

| Layer | Composition | Amount ($g/m^2$) |
|---|---|---|
| Layer 4 (UV-absorption layer) | Gelatin | 0.94 |
| | UV-absorbent (UV-1) | 0.28 |
| | UV-absorbent (UV-2) | 0.09 |
| | UV-absorbent (UV-3) | 0.38 |
| | Antistaining agent (HQ-1) | 0.03 |
| | DNP | 0.40 |
| Layer 3 (Green-sensitive layer) | Gelatin | 1.40 |
| | Green-sensitive silver chlorobromide emulsion (Em-G) | 0.17 |
| | Magenta coupler (EM-1) | 0.75* |
| | DNP | 0.20 |
| | Dye-image stabilizer (Is-2) | 0.75* |
| | Dye-image stabilizer (IIs-2) | 0.75* |
| | Anti-irradiation dye (AIM-1) | 0.01 |
| Layer 2 (Intermediate layer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| Layer 1 (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper | |

*$mmol/m^2$

The coated amounts of silver halide emulsions were indicated as calculated in terms of silver.

The coating compositions were prepared in the following manner.Coating composition for Layer 1

Sixty (60) ml of ethyl acetate was added to 26.7 g of yellow coupler (Y-1), 10.0 g of dye-image stabilizer (ST-1), 6.67 g of dye-image stabilizer (ST-2), 0.67 g of antistaining agent (HQ-1), 6.67 g of high-boiling organic solvent (DNP), and the mixture thereof was dissolved. The resulting solution was emulsified and dispersed in 220 ml of an aqueous 10% gelatin solution containing 7.0 ml of 20% surfactant (SU-2) by making use of an ultrasonic homogenizer, so that a yellow coupler dispersed solution could be prepared.

The resulting dispersed solution was mixed with a blue light-sensitive silver halide emulsion (containing 8.67 g of silver) and an anti-irradiation dye (AIY-1) was further added thereto, so that a coating composition for Layer 1 was prepared.

Coating compositions for Layers 2 through 7 were each prepared in a manner similar to the above-mentioned coating composition for Layer 1. As a hardener, (HH-1) was added to each of Layers 2 and 4 and (HH-2) to Layer 7. As a coating aid, surfactants (SU-1) and (SU-3) were added thereto, so that the surface tension of the layers were controlled.

Compounds used in the afore-mentioned layers are shown below.

EY-1

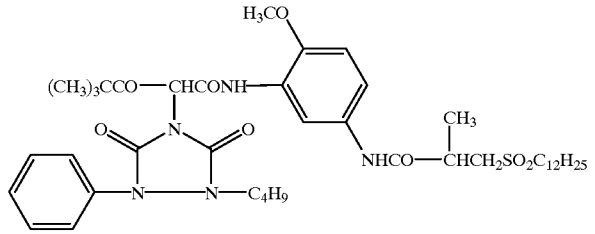

EC-1

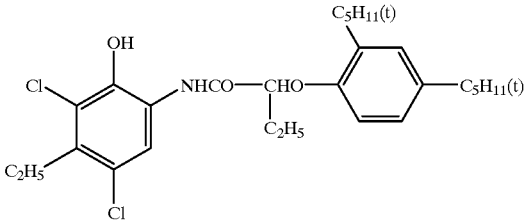

EC-2

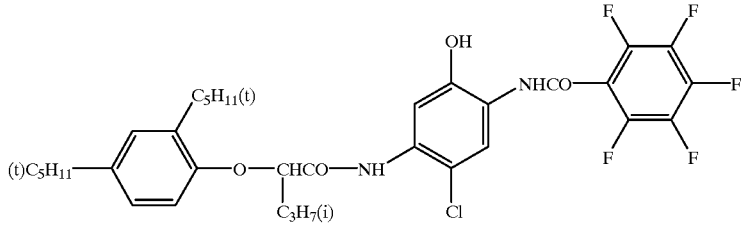

-continued
ST-1
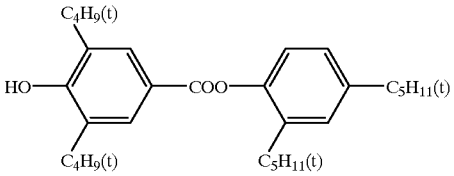
ST-2
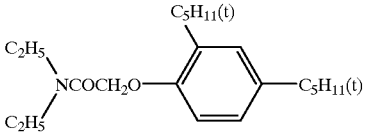
EM-1 (Comparative Coupler)
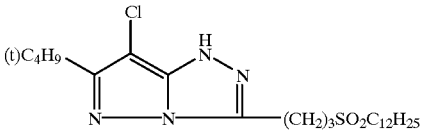
UV-1
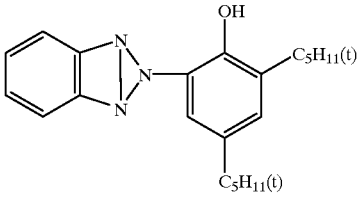
UV-2
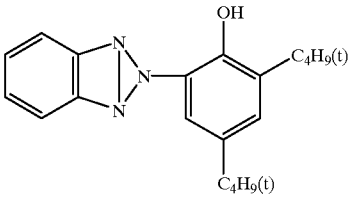
UV-3
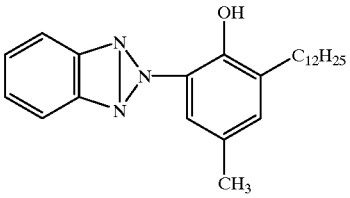
DOP Dioctyl phthalate
DNP Dinonyl phthalate
DIDP Diisodecyl phthalate
PVP Polyvinyl pyrrolidone
HQ-1
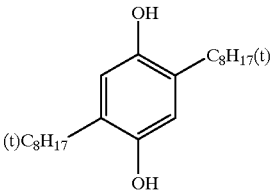
HQ-2
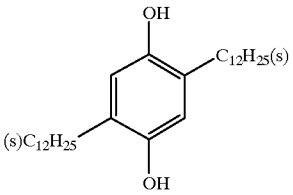
HQ-3
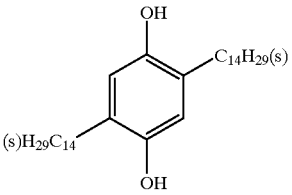
HQ-4
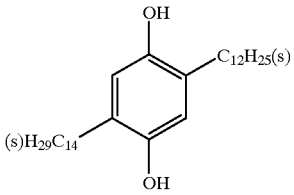
HQ-5
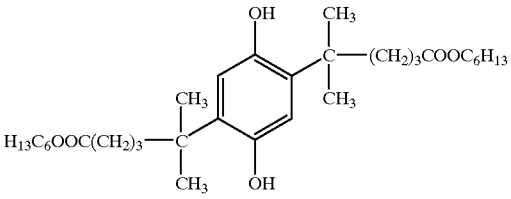
HBS-1
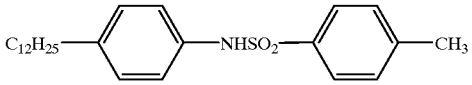
AIM-1
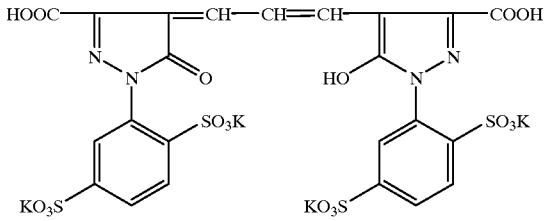

-continued

AIC-1

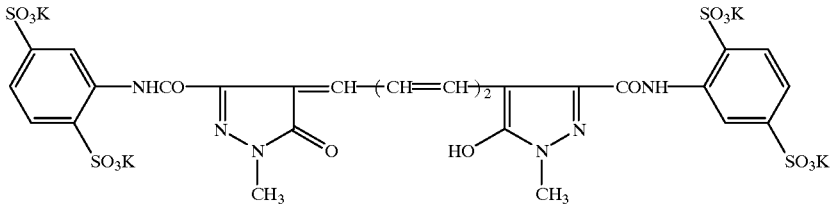

AIY-1

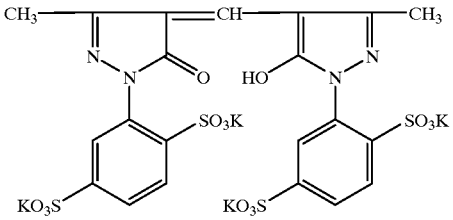

SU-1

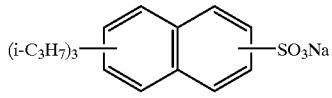

SU-2

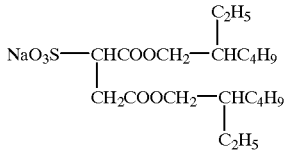

SU-3

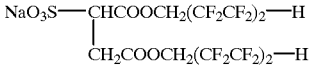

HH-1

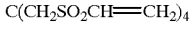

HH-2

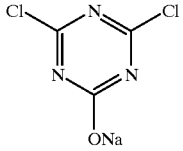

F-1

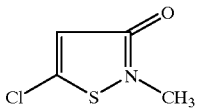

Silver halide emulsions used in Layers 1, 3 and 5 are as follows. Chemical sensitizers, stabilizers and optical sensitizers are shown as well.

Blue-sensitive Silver Halide Emulsion (Em-B):

A monodispersed silver bromochloride cubic grain emulsion having an average grain size of 0.85 $\mu$m, variation coefficient of grain size of 0.07 and chloride content of 99.5 mol %.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-sensitive Silver Halide Emulsion (Em-G):

A monodispersed silver bromochloride cubic grain emulsion having an average grain size of 0.43 $\mu$m, variation coefficient of grain size of 0.08 and chloride content of 99.5 mol %.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Red-sensitive Silver Halide Emulsion (Em-R)

A monodispersed silver bromochloride cubic grain emulsion having an average grain size of 0.50 $\mu$m, variation coefficient of grain size of 0.08 and chloride content of 99.5 mol %.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

BS-1

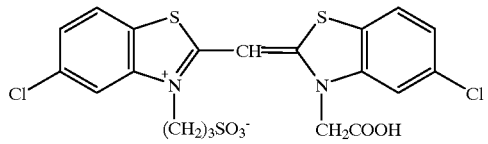

-continued

BS-2

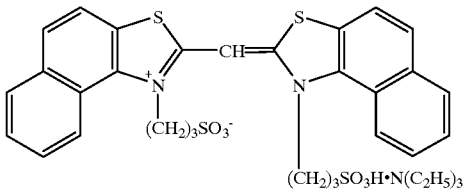

GS-1

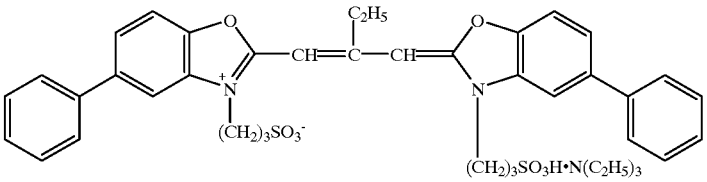

RS-1

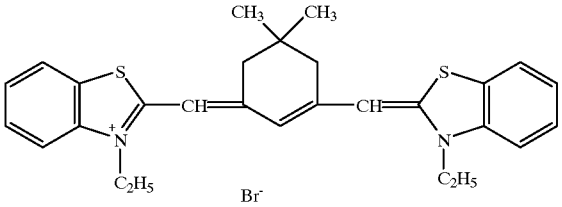

STAB-1

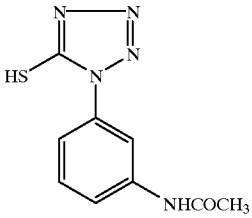

Samples 102 through 110 were prepared in the same manner as in Sample 101, except that coupler EM-1 used in Layer 3 was replaced by an equimolar amount of an inventive coupler or comparative coupler as shown in Table 2.

The resulting Samples 101 through 110 were exposed to green light through a wedge in an ordinary method and were then processed according to the following steps.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30° C. to 34° C. | 90 sec. |
| Drying | 60° C. to 80° C. | 60 sec. |

The compositions of the processing solutions used in each of the processing steps were as follows. The replenishing rate of each processing solution was 80 cc per $m^2$ of the photographic material.

Color Developer:

| | Tank soln. | Replenisher |
|---|---|---|
| Water | 800 ml | 800 ml |
| Triethanol amine | 10 g | 18 g |

-continued

| | Tank soln. | Replenisher |
|---|---|---|
| N,N-diethyl hydroxylamine | 5 g | 9 g |
| Potassium chloride | 2.4 g | — |
| 1-Hydroxyethylidene-1,1-diphosphonic acid | 1.0 g | 1.8 g |
| 3-Methyl-4-amino-N-ethyl-N-(β-methane sulfonamido ethyl)aniline | 5.4 g | 8.2 g |
| Fluorescent whitening agent (4,4'-diamino stilbene sulfonic acid derivative) | 1.0 g | 1.8 g |
| Potassium carbonate | 27 g | 27 g |
| Add water to make in total of | 1,000 cc | |

The pH of the tank solution and replenisher were adjusted to 10.10 and 10.60, respectively.

Bleach-fixer:

(A tank solution and replenisher were the same.)

| | |
|---|---|
| Ferric ammonium ethylenediamine tetraacetate, dihydrate | 60 g |
| Ethylenediamine tetraacetic acid | 3 g |
| Ammonium thiosulfate (in an aqueous 70% solution) | 100 cc |
| Ammonium sulfite (in an aqueous 40% solution) | 27.5 cc |
| Add water to make in total of | 1,000 cc |

-continued

| | |
|---|---|
| Adjust pH with potassium carbonate or glacial acetic acid to be | 5.7 |

| Stabilizer: | |
|---|---|
| (A tank solution and replenisher ere the same.) | |
| 5-Chloro-2-methyl-4-isothiazoline-3-one | 1.0 g |
| Ethylene glycol | 1.0 g |
| 1-Hydroxyethylidene-1,1-diphoshonic acid | 2.0 g |
| Ethylenediamine tetraacetic acid | 1.0 g |
| Ammonium hydroxide (in an aqueous 20% solution) | 3.0 g |
| Fluorescent whitening agent (4,4'-diamino stilbene sulfonic acid derivative) | 1.5 g |
| Add water to make in total of | 1,000 cc |
| Adjust pH with sulfuric acid or potassium hydroxide to be | 7.0 |

After running continuous processing, each sample was evaluated with respect to the following items.

Dmax:

The maximum density of each sample was measured.

Light Fastness:

Processed samples each were subjected to light exposure over a period of 10 days, using a xenon Fade-O-meter. Residual color density of the dye image at an initial density of 1.0 was measured and the light fastness was evaluated in terms of the residual dye ratio (%), based on the initial density of 1.0.

Optical absorption characteristics λmax and $\Delta\lambda 1_{0.2}$ were evaluated by means of measurement of reflection optical absorption spectrum of Samples 101 to 110.

λmax represents wave length of maximum absorption of wedge at reflective density of 1.0.

$\Delta\lambda 1_{0.2}$ represents difference between the wave length, which is longer than the wave length at maximum absorption, giving absorbency of 0.2 of wedge at reflective density of 1.0 and the maximum wave length, wherein the light absorbency at λmax is set as 1.0, and the smaller this value is, the sharper the absorption is.

Results thereof are shown in Table 3.

TABLE 3

| Sample No. | Magenta coupler | Dmax | Residual Dye Ratio (%) | λmax (nm) | $\Delta\lambda 1_{0.2}$ (nm) |
|---|---|---|---|---|---|
| 101 (Comp.) | EM-1 | 2.29 | 65 | 545 | 88 |
| 102 (Inv.) | M-3 | 2.58 | 79 | 545 | 78 |
| 103 (Inv.) | M-5 | 2.47 | 86 | 546 | 75 |
| 104 (Inv.) | M-7 | 2.60 | 82 | 548 | 75 |
| 105 (Inv.) | M-13 | 2.78 | 87 | 546 | 78 |
| 106 (Inv.) | M-15 | 2.62 | 89 | 548 | 76 |
| 107 (Inv.) | M-17 | 2.60 | 80 | 548 | 79 |
| 108 (Inv.) | M-33 | 2.45 | 74 | 547 | 81 |
| 109 (Inv.) | M-36 | 2.46 | 76 | 545 | 80 |
| 110 (Inv.) | M-60 | 2.35 | 72 | 546 | 84 |

As apparent seen from Table 3, the samples 102–110 employing magenta couplers of the invention are improved in both of color forming property and light fastness, as compared to sample 101 employing comparative couplers.

Further the samples 102–110 employing magenta couplers of the invention give reduced $\Delta\lambda 1_{0.2}$ value (i.e., absorption is sharper) and are improved in color reproduction, as compared to sample 101 employing comparative couplers.

Samples 102–109 are superior to Sample 110 in comparison of Samples 102–109 with Sample 110 in view of the above evaluation, and this means that the magenta coupler having skeleton of (I) is better.

Example 2

Samples 201 to 207 were prepared in the similar way to Sample 101 except that the magenta coupler and dye stabilizer in the third layer were replaced by combination of magenta coupler and dye stabilizer with their amount shown in Table 4, and further, DNP in the third layer was replaced by the equi-weight of 1:1 mixture of oleyl alcohl and dibutylphthalate.

Samples thus prepared were exposed by green light through wedge in usual way and processed in the same way as Example 1.

The same evaluation was conducted for each samples after continuous processing.

Dmax:

The maximum density of each sample was measured.

Light Fastness:

Processed samples each were subjected to light exposure over a period of 15 days, using a xenon Fade-O-meter. Residual color density of the dye image at an initial density of 1.0 was measured and the light fastness was evaluated in terms of the residual dye ratio (%), based on the initial density of 1.0.

Reflective absorption spectrum each of Samples 201 to 207 was measured to evaluate the spectroscopic characteristics λmax and $\Delta\lambda 1_{0.2}$.

λmax represents wave length of maximum absorption of wedge at reflective density of 1.0.

$\Delta\lambda 1_{0.2}$ represents difference between the wave length, which is longer than the wave length at maximum absorption, giving absorbency of 0.2 of wedge at reflective density of 1.0 and the maximum wave length, wherein the light absorbency at λmax is set as 1.0, and the smaller this value is, the sharper the absorption is.

Results thereof are shown in Table 4.

TABLE 4

| Sample No | Magenta coupler in 3rd layer | Dye stabiliser in layer | Dmax | Residual Dye Ratio (%) | λmax (nm) | $\Delta\lambda 1_{0.2}$ (nm) |
|---|---|---|---|---|---|---|
| 201 (Comp.) | EM-1 (0.75)* | IIs-2 (0.375) & IIIs-1 (1.5)* | 2.20 | 71 | 544 | 85 |
| 202 (Inv.) | M-1 (0.75) | IIs-2 (0.375) & IIIs-1 (1.5)* | 2.33 | 81 | 545 | 79 |
| 203 (Inv.) | M-65 (0.75) | IIs-2 (0.375) & IIIs-1 (1.5)* | 2.25 | 87 | 545 | 74 |
| 204 (Inv.) | M-67 (0.75) | IIs-2 (0.375) & IIIs-1 (1.5)* | 2.30 | 88 | 545 | 76 |
| 205 (Inv.) | M-83 (0.75) | IIs-2 (0.375) & IIIs-1 (1.5)* | 2.38 | 87 | 545 | 76 |
| 206 (Inv.) | M-85 (0.75) | IIs-2 (0.375) & IIIs-1 (1.5)* | 2.35 | 91 | 548 | 75 |
| 207 (Inv.) | M-92 (0.75) | IIs-2 (0.375) & IIIs-1 (1.5)* | 2.40 | 84 | 544 | 77 |

*Value shown in ( ) of magenta coupler and dye stabilizer is adding amount in mmol/m$^2$.

As apparent seen from Table 4, the samples 202–207 employing magenta couplers of the invention are improved in both of color forming property and light fastness, as compared to sample 201 employing comparative couplers.

Further the samples 202–207 employing magenta couplers of the invention give reduced $\Delta\lambda 1_{0.2}$ value (i.e., absorption is sharper) and are improved in color reproduction, as compared to sample 201 employing comparative couplers.

We claim:

1. A silver halide color photographic light sensitive material comprising a support having thereon a blue-sensitive silver halide emulsion layer, green-sensitive silver halide emulsion layer and a red-sensitive silver halide emulsion layer, wherein said green-sensitive silver halide emulsion layer comprises a coupler represented by the following formula (M-I):

Formula (M-I)

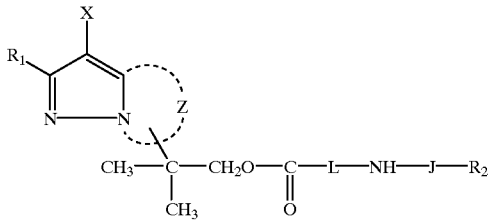

wherein $R_1$ represents a substituent; $R_2$ represent an alkyl group, cycloalky group or aryl group, all of which may have a substituent; L represents an alkylene group which may have a substituent; J represents a group of —(C═O)— or —(O═S═O)—; X represents a hydrogen atom or a group capable of being released upon reaction with an oxidation product of a developing agent; and Z represents an atomic group necessary for forming a nitrogen-containing heterocyclic group.

2. A silver halide color photographic light sensitive material of claim 1 wherein the magenta coupler is represented by formula M-Ia

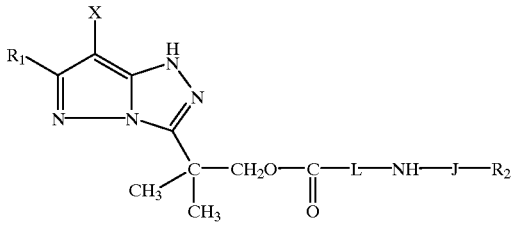

-continued or

M-Ib

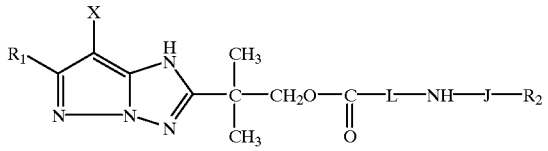

wherein $R_1$ represents a substituent; $R_2$ represent an alkyl group, cycloalky group or aryl group, all of which may have a substituent; L represents an alkylene group which may have a substituent; J represents a group of —(C═O)— or —(O═S═O)—; X represents a hydrogen atom or a group capable of being released upon reaction with an oxidation product of a developing agent; and Z represents an atomic group necessary for forming a nitrogen-containing heterocyclic group.

3. A silver halide color photographic light sensitive material of claim 1 wherein J represents a group of —(C═O)—.

4. A silver halide color photographic light sensitive material of claim 1 wherein J represents a group of —(O═S═O)—.

5. A silver halide color photographic light sensitive material of claim 1 wherein $R_1$ represents an alkyl group.

6. A silver halide color photographic light sensitive material of claim 5 wherein $R_1$ represents a t-butyl group.

7. A silver halide color photographic light sensitive material of claim 1 wherein $R_2$ represent an alkyl or aryl group, which may have a substituent.

8. A silver halide color photographic light sensitive material of claim 7 wherein $R_2$ represent an alkyl group which may have a substituent.

9. A silver halide color photographic light sensitive material of claim 1 wherein X represents a chlorine atom.

10. A silver halide color photographic light sensitive material of claim 1 wherein L is —$CH_2CH_2$—.

* * * * *